United States Patent [19]

Minegishi et al.

[11] 4,134,840

[45] Jan. 16, 1979

[54] SOFTENER COMPOSITION FOR FABRICS

[75] Inventors: Yutaka Minegishi, Miyashiromachi; Haruhiko Arai, Narashino, both of Japan

[73] Assignee: Kao Soap Co., Ltd., Tokyo, Japan

[21] Appl. No.: 827,857

[22] Filed: Aug. 26, 1977

[30] Foreign Application Priority Data

Sep. 17, 1976 [JP] Japan ..... 51-111544

[51] Int. Cl.[2] ..... D06M 13/46

[52] U.S. Cl. ..... 252/8.9; 252/8.75; 252/8.8; 546/587; 546/588

[58] Field of Search ..... 252/8.8, 8.9, 8.75; 260/535 R

[56] References Cited

U.S. PATENT DOCUMENTS

| | | | |
|---|---|---|---|
| 2,109,947 | 3/1938 | North | 260/535 R |
| 2,183,853 | 12/1939 | Mannheim et al. | 260/535 R |
| 2,623,900 | 12/1952 | Basel | 260/535 R |
| 3,364,142 | 1/1968 | Buck | 252/8.9 |
| 3,974,076 | 8/1976 | Wiersema et al. | 252/8.9 |
| 4,038,196 | 7/1977 | Minegishi et al. | 252/8.8 |

*Primary Examiner*—William E. Schulz

*Attorney, Agent, or Firm*—Blanchard, Flynn, Thiel, Boutell & Tanis

[57] ABSTRACT

A fabric softener composition comprising (A) a quaternary ammonium salt having one or two alkyl groups having 11 to 24 carbon atoms and (B) an ether carboxylate, wherein the (A)/(B) mixing molar ratio is from 1/0.5 to 1/1.

8 Claims, No Drawings

SOFTENER COMPOSITION FOR FABRICS

BACKGROUND OF THE INVENTION

1. Field of the Invention

The present invention relates to a softener composition for fabrics comprising a quaternary ammonium salt and an ether carboxylate. The composition has excellent softening and antistatic effects to various fibers and has a good dispersibility.

2. Description of the Prior Art

Most of the presently commercially available fabric softener compositions for ordinary household use are compositions comprising, as a main ingredient, a quaternary ammonium salt having in the molecule 1 or 2 long-chain alkyl groups. The reason is that such quaternary ammonium salts exert a very high softening effect to cotton fibers, even when used in a small amount.

In recent years, the proportions of synthetic fibers in cloth materials in households has rapidly increased. However, cloths made of synthetic fibers become hard when they are repeatedly worn and washed, and they readily become electrostatically charged. Therefore, they must be subjected to softening and antistatic treatments.

Quaternary ammonium salts, as mentioned above, have a very high softening effect to cotton fibers but it cannot be said that they are satisfactory in both their softening and antistatic effects to synthetic fibers. Among industrial softeners, which are not used in households, there are only a few softeners which are satisfactory in both the softening and antistatic effects to synthetic fibers. Accordingly, in general, agents excellent in the softening effect and agents excellent in the antistatic effect are used in combination for treating synthetic fibers. Further, agents which are satisfactory in both the softening and antistatic effects to synthetic fibers must be employed for treatment at a very high concentration and therefore, they are not suitable for ordinary household use. Moreover, these softeners for synthetic fibers are inferior in their softening effect to cotton fibers.

As will be apparent from the foregoing description, there has not been developed a household fabric softener composition having a high softening effect to various fibers and which also is excellent in its antistatic effect to synthetic fibers.

It is therefore a primary object of the present invention to provide a fabric softener composition having a softening effect to cotton as high as the softening effect attained by conventional softeners in the case of the household softening treatment and also having much higher softening and antistatic effects to synthetic fibers than those attained by conventional softeners.

SUMMARY OF THE INVENTION

In accordance with the present invention, this object can be attained by a softener composition for fabrics comprising (A) a quaternary ammonium salt having in the molecule one or two alkyl groups having 11 to 24 carbon atoms and (B) an ether carboxylate having the formula:

$$RO(CH_2CH_2O)_pR'COOM$$

wherein R is alkyl or alkenyl having 10 to 22 carbon atoms, p is a number of from 0 to 5, M is an alkali metal or water-soluble ammonium group, and R' is alkylene having 1 to 3 carbon atoms, the (A)/(B) mixing molar ratio being in the range of from 1/0.5 to 1/1.

Softener compositions for fabrics comprising a quaternary ammonium salt combined with a carboxylic acid type compound are disclosed in U.S. Pat. No. 3,920,563 (issued to Wixon on Nov. 18, 1975) and U.S. Pat. No. 3,920,565 (issued to Morton on Nov. 18, 1975). In these known softener compositions, a long-chain fatty acid salt is used as the carboxylic acid salt. Further, the purpose of using such fatty acid salt is for preventing degradation of the softening effect otherwise caused by deactivation of the quaternary ammonium salt by the anionic detergent component left in the clothes after washing thereof. Therefore, in such known softener compositions, the fatty acid salt is different from the ether carboxylate of the present invention with respect to the structure of the carboxylate and the intended purpose of using it, even though both the salts contain a carboxyl group. Thus, the present invention is clearly distinguishable over these known softener compositions.

The quaternary ammonium salt that is used in the present invention includes, for example, the following ammonium, imidazolinium and amidoammonium salts having in the molecule one or two alkyl groups having 11 to 24 carbon atoms or β-hydroxy alkyl having 13 to 24 carbon atoms.

(I) Ammonium salts having the formula:

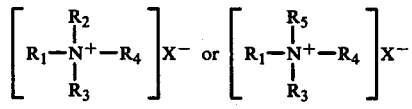

(II) Imidazolinium salts having the formula:

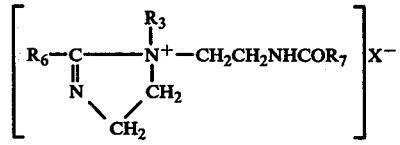

(III) Amidoammonium salts having the formula:

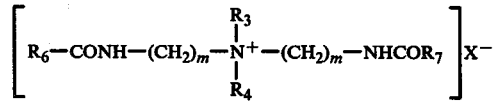

or

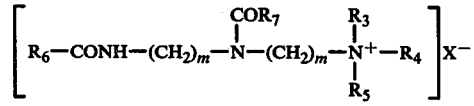

In the foregoing formulae (I), (II) and (III), $R_1$, $R_2$, $R_6$ and $R_7$ each is alkyl having 11 to 24 carbon atoms or β-hydroxyalkyl having 13 to 24 carbon atoms, $R_3$, $R_4$ and $R_5$ each is alkyl or hydroxyalkyl having 1 to 3 carbon atoms, benzyl or $-(C_2H_4O)_nH$ in which n is 1 to 3, m is 2 or 3, and X is halogen or a monoalkyl sulfate group containing an alkyl group having 1 to 3 carbon atoms.

More specifically, the quaternary ammonium salt that is used in the present invention includes, for example, dodecyltrimethyl ammonium chloride, hexadecyldimethylethyl ammonium bromide, octadecyltrimethyl ammonium chloride, didodecyldimethyl ammonium chloride, dihexadecyldimethyl ammonium chloride, dioctadecyldimethyl ammonium chloride, di-(hydrogenated beef tallow alkyl)dimethyl ammonium chloride, 2-heptadecyl-1-methyl-1-[(2-octadecanoylamino)-ethyl-]imidazolinium methyl sulfate, di-[(2-dodecanoylamino)-ethyl]dimethyl ammonium methyl sulfate, di-[(2-octadecanoylamino)ethyl]methylethyl ammonium ethyl sulfate, and mixtures of two or more of these quaternary ammonium salts.

The ether carboxylate that is used in the present invention is a compound having the formula:

$$RO(CH_2CH_2O)_pR'COOM$$

wherein R is alkyl or alkenyl having 10 to 22 carbon atoms, R' is alkylene having 1 to 3 carbon atoms, p is a number of from 0 to 5, and M is an alkali metal or water-soluble ammonium group. More specifically, there can be mentioned sodium 2-(dodecyloxy)-acetate, potassium 2-(dodecyloxytriethenoxy)-2-ethyl-acetate, ammonium 3-(hexadecyloxyethenoxy)propionate, sodium 2-(octadecyloxytriethenoxy)-acetate, sodium 2-(octadecenyloxydiethenoxy)-acetate, and mixtures of two or more of these ether carboxylates.

The mixing molar ratio of the quaternary ammonium salt (A) and ether carboxylate (B) that are used in the fabric softener of the present invention, namely the mixing molar ratio (A):(B), is from 1:0.5 to 1:1, preferably from 1:0.75 to 1:0.9. When the fabric softener composition of the present invention is used in the liquid form, the total amount of the components (A) and (B) is not particularly critical, but when application conditions in ordinary households are taken into consideration, in view of the softening and antistatic effects, it is preferred that the total amount of the components (A) and (B) be at least 3% by weight, based on the total weight of the liquid, and in view of the viscosity and storage stability of the liquid composition and from the economical viewpoint, it is preferred that the total amount of the components (A) and (B) is not larger than 20% by weight, based on the total weight of the liquid composition.

The softener composition for fabrics according to the present invention is characterized by the combined use of the quaternary ammonium salt (A) and the ether carboxylate (B). When it is used in the form of a liquid softener, the composition of the present invention may further comprise a polyethylene glycol-type non-ionic surface active agent, a water-soluble salt such as sodium chloride or ammonium chloride, a solvent such as propylene glycol or isopropyl alcohol, or urea for improving the storage stability or adjusting the viscosity.

Moreover, a pigment or dye may be incorporated for improving the appearance of the resulting product, or a fluorescent dye may be incorporated for enhancing the whiteness of the treated fabric. Furthermore, a perfume may be incorporated for giving a good feeling during the treatment or imparting a good odor to the treated fabric.

The present invention will now be further described by reference to the following illustrative Examples.

EXAMPLE 1

The softening and antistatic effects of compositions having the recipe set forth below on various fibers were examined.

| Recipe | |
|---|---|
| Distearyldimethyl ammonium chloride (A) | 6% by weight (0.0102 mole) |
| Sodium 2-(octadecyloxytri-ethenoxy)-acetate (B) | 0 to 1.25 molar equivalents to (A) |
| Water | balance |

(1) Softening Treatment:

Commercially available cotton towel, acrylic jersey cloth, nylon knitwork and Tetron knitwork were washed repeatedly 5 times with a commercially available detergent, New Beads (a registered trademark for a product of Kao Soap Co., Ltd.), and fiber treating agents were removed from the thus-washed fiber products. Then, the fiber products were treated in a 0.033 or 0.067% aqueous solution of the above composition (water having a hardness of 3.5° DH being used) at a temperature of 25° C and a bath ratio of 1/30 for 5 minutes under agitation.

(2) Evaluation

The clothes treated according to the above-mentioned method were air-dried in a room and were allowed to stand still in a thermostat chamber maintained at a temperature of 25° C and a relative humidity of 65% for 24 hours.

The softness and antistatic characteristic of each cloth were evaluated in the following manners.

(a) softness

The softness was evaluated according to the paired comparison testing method using as a control a cloth treated with a softener composition free of the ether carboxylate. The evaluation scale is as follows:

+ 3: very soft
+ 2: soft
+ 1: relatively soft
0: same as control
− 1: relatively hard
− 2: hard
− 3: very hard (b) The antistatic characteristic was evaluated based on the surface resistivity measured by using High Resistance Meter Model 4329A manufactured by Yokokawa Hewlett Packard Co.

(3) Results

The results obtained are shown in Table 1. As will be apparent from the results shown in Table 1, when the ether carboxylate (B) is added to the quaternary ammonium salt (A) so that the (B)/(A) molar ratio is from 0.50 to 1.00, preferably from 0.75 to 0.9, the softness and antistatic characteristic of the synthetic fibers can be much improved in comparison with the case in which the component (B) is not added.

In addition, the softness of cotton tends to decrease somewhat by addition of an ether carboxylate (B). However such tendency is minor when the ratio of (B) to (A) is 1.00 or less. In that range, it can be said that the softness of cotton fabrics is very much sufficient.

Table 1

| | Softening Effect | | | | | | | |
|---|---|---|---|---|---|---|---|---|
| | Acrylic Jersey | | Nylon Knitwork | | Tetron Knitwork | | Cotton Towel | |
| (B)/(A) Molar Ratio | 0.033 wt.% | 0.067 wt.% | 0.033 wt.% | 0.067 wt.% | 0.033 wt.% | 0.067 wt.% | 0.033 wt.% | 0.067 wt.% |
| 0 | control | | control | | control | | control | |
| 0.25 | + 1 | + 0.5 | 0 | 0 | 0 | 0.5 | 0 | 0 |
| 0.50 | + 2 | + 3 | + 1 | + 1 | + 1 | + 1 | 0 | 0 |
| 0.75 | + 3 | + 3 | + 2 | + 2 | + 2 | + 2 | − 0.5 | − 0.5 |
| 0.90 | + 3 | + 3 | + 2 | + 2 | + 2 | + 2 | − 0.5 | − 0.5 |
| 1.00 | + 2 | + 3 | + 1 | + 1 | + 1 | + 1 | − 1 | − 1 |
| 1.25 | − 2 | − 2 | − 1 | − 1 | − 1 | − 1 | − 2 | − 2 |
| | Surface Resistivity (Ω) | | | | | | | |
| 0 | $7.9\times10^{12}$ | $6.3\times10^{11}$ | $7.3\times10^{12}$ | $1.4\times10^{12}$ | $2.2\times10^{12}$ | $1.0\times10^{11}$ | — | |
| 0.25 | $5.6\times10^{12}$ | $7.9\times10^{11}$ | $6.1\times10^{12}$ | $1.2\times10^{12}$ | $1.7\times10^{12}$ | $8.9\times10^{10}$ | — | |
| 0.50 | $2.8\times10^{12}$ | $1.1\times10^{10}$ | $9.1\times10^{11}$ | $4.7\times10^{11}$ | $5.2\times10^{11}$ | $4.3\times10^{10}$ | — | |
| 0.75 | $7.8\times10^{10}$ | $8.1\times10^{9}$ | $2.8\times10^{11}$ | $3.2\times10^{10}$ | $1.6\times10^{10}$ | $8.9\times10^{9}$ | — | |
| 0.90 | $2.5\times10^{10}$ | $4.0\times10^{9}$ | $4.5\times10^{11}$ | $3.2\times10^{10}$ | $3.5\times10^{9}$ | $1.3\times10^{9}$ | — | |
| 1.00 | $3.5\times10^{11}$ | $6.3\times10^{9}$ | $9.7\times10^{11}$ | $1.2\times10^{11}$ | $4.9\times10^{10}$ | $2.2\times10^{10}$ | — | |
| 1.25 | above $10^{14}$ | above $10^{14}$ | above $10^{14}$ | above $10^{14}$ | above $10^{14}$ | above $10^{14}$ | | |

EXAMPLE 2

| | |
|---|---|
| Distearyldimethyl ammonium chloride (molecular weight = 586) | 3% by weight |
| Sodium 2-(dodecyloxy)-acetate (molecular weight = 266) | 0.7% by weight |
| Water | balance |

EXAMPLE 3

| | |
|---|---|
| Distearyldimethyl ammonium chloride (molecular weight = 586) | 10% by weight |
| Potassium 2-(dodecyloxypenta-ethenoxy)-2-ethylacetate (molecular weight = 494) | 8.4% by weight |
| Polyoxyethylene(p = 100) lauryl ether | 0.5% by weight |
| Water | balance |

EXAMPLE 4

| | |
|---|---|
| Distearyldimethyl ammonium chloride (molecular weight = 586) | 6% by weight |
| Sodium 2-(hexadecyloxytri-ethenoxy)-acetate (molecular weight = 454) — | 3.5% by weight |
| Polyoxyethylene(p = 100) oleyl ether | 0.5% by weight |
| Perfume and pigment | minute amounts |
| Water | balance |

EXAMPLE 5

| | |
|---|---|
| Distearyldimethyl ammonium chloride (molecular weight = 586) | 4.5% by weight |
| Sodium 2-(octadecenyloxydiethenoxy)-acetate (molecular weight = 436) | 3.0% by weight |
| Urea | 2% by weight |
| Water | balance |

EXAMPLE 6

| | |
|---|---|
| Di-(hydrogenated beef tallow alkyl)dimethyl ammonium chloride (molecular weight = 563) | 6% by weight |
| Sodium 2-(octadecyloxytri-ethenoxy)-acetate (molecular weight = 482) | 4.6% by weight |
| Propylene glycol | 5% by weight |
| Perfume and pigment | minute amounts |
| Water | balance |

EXAMPLE 7

| | |
|---|---|
| 2-Heptadecyl-1-methyl-1-[(2-octadecanoylamino)ethyl] imidazolinium methyl sulfate (molecular weight = 743) | 7% by weight |
| Sodium 2-(octadecyloxytri-ethenoxy)-acetate (molecular weight = 482) | 4.1% by weight |
| Perfume and pigment | minute amounts |
| Water | balance |

EXAMPLE 8

| | |
|---|---|
| Di-[(2-octadecanoylamino)-ethyl]dimethyl ammonium methyl sulfate (molecular weight = 775) | 5% by weight |
| Sodium 2-(octadecyloxytri-ethenoxy)-acetate (molecular weight = 482) | 2.8% by weight |
| Urea | 4% by weight |
| Sodium chloride | 0.5% by weight |
| Water | balance |

EXAMPLE 9

| | |
|---|---|
| Docosyltrimethyl ammonium chloride (molecular weight = 404) | 6% by weight |
| Sodium 2-(octadecyloxytri-ethenoxy)-acetate (molecular weight = 482) | 6.4% by weight |
| Propylene glycol | 3% by weight |
| Sodium chloride | 0.1% by weight |
| Water | balance |

In the same manner as described in Example 1, the softening and antistatic effects of each of the compositions of the foregoing Examples 2 to 9 were evaluated by using as a control a corresponding composition (Controls 2–9) free of the ether carboxylate. The concentration of the softener compositions was 0.067% by weight in all the tests. The results obtained are shown in Table 2.

As will be apparent from the results shown in Table 2, when the ether carboxylate (B) is added to the quaternary ammonium salt (A), the softening and antistatic effects to synthetic fibers can be remarkably improved, and the softening effect to cotton fibers are not conspicuously degraded.

Table 2

| Example No. | (B)/(A) Molar Ratio | Softening Effect: Acrylic Jersey | Nylon Knitwork | Tetron Knitwork | Cotton Towel | Surface Resistivity (Ω): Acrylic Jersey | Nylon Knitwork | Tetron Knitwork |
|---|---|---|---|---|---|---|---|---|
| 2 | 0.5 | + 2 | + 1 | + 1 | 0 | $1.8\times10^{12}$ | $2.2\times10^{11}$ | $5.6\times10^{10}$ |
| 3 | 1.0 | + 3 | + 2 | + 2 | − 1 | $4.0\times10^{10}$ | $2.1\times10^{11}$ | $4.5\times10^{10}$ |
| 4 | 0.75 | + 3 | + 2 | + 2 | − 0.5 | $7.0\times10^{9}$ | $3.2\times10^{10}$ | $1.8\times10^{10}$ |
| 5 | 0.9 | + 2 | + 1 | + 1 | − 0.5 | $1.0\times10^{10}$ | $1.2\times10^{11}$ | $3.1\times10^{9}$ |
| 6 | 0.9 | + 3 | + 2 | + 2 | − 0.5 | $4.0\times10^{9}$ | $3.1\times10^{10}$ | $1.3\times10^{9}$ |
| 7 | 0.9 | + 2 | + 2 | + 1 | − 1 | $3.5\times10^{10}$ | $8.7\times10^{11}$ | $4.9\times10^{10}$ |
| 8 | 0.9 | + 2 | + 2 | + 2 | − 1 | $1.5\times10^{11}$ | $4.3\times10^{11}$ | $1.0\times10^{11}$ |
| 9 | 0.9 | + 2 | + 1 | + 2 | − 0.5 | $2.1\times10^{11}$ | $5.9\times10^{11}$ | $8.3\times10^{9}$ |
| Control 2 | 0 | control | control | control | control | $7.9\times10^{12}$ | $7.3\times10^{12}$ | $2.2\times10^{12}$ |
| Control 3 | 0 | " | " | " | " | $4.0\times10^{11}$ | $8.9\times10^{11}$ | $2.0\times10^{11}$ |
| Control 4 | 0 | " | " | " | " | $6.3\times10^{11}$ | $1.5\times10^{11}$ | $3.0\times10^{11}$ |
| Control 5 | 0 | " | " | " | " | $2.5\times10^{12}$ | $5.2\times10^{12}$ | $1.8\times10^{11}$ |
| Control 6 | 0 | " | " | " | " | $5.0\times10^{11}$ | $1.4\times10^{12}$ | $2.5\times10^{11}$ |
| Control 7 | 0 | " | " | " | " | $4.0\times10^{11}$ | $5.0\times10^{12}$ | $3.2\times10^{11}$ |
| Control 8 | 0 | " | " | " | " | $2.0\times10^{12}$ | $6.3\times10^{12}$ | $1.0\times10^{12}$ |
| Control 9 | 0 | " | " | " | " | $2.1\times10^{12}$ | $8.6\times10^{12}$ | $3.5\times10^{12}$ |

The embodiments of the invention in which an exclusive property or privilege is claimed are defined as follows:

1. A softener composition for fabrics consisting essentially of (A) a quaternary ammonium salt having in the molecule one or two alkyl groups having 11 to 24 carbon atoms and (B) an ether carboxylate having the formula:

$$RO(CH_2CH_2O)_pR'COOM$$

wherein R is alkyl or alkenyl having 10 to 22 carbon atoms, p is a number of from zero to 5, M is an alkali metal or water-soluble ammonium group, and R' is alkylene having 1 to 3 carbon atoms, the (A)/(B) mixing molar ratio being in the range of from 1/0.5 to 1/1.

2. A softener composition for fabrics as set forth in claim 1 wherein the quaternary ammonium salt is a compound having the formula:

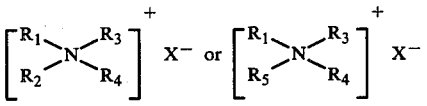

wherein $R_1$ and $R_2$ each is alkyl having 11 to 24 carbon atoms or a β-hydroxyalkyl group having 13 to 24 carbon atoms, $R_3$, $R_4$ and $R_5$ each is alkyl or hydroxyalkyl having 1 to 3 carbon atoms, benzyl or $-(C_2H_4O)_nH$ in which n is a number of from 1 to 3, and X is halogen or a monoalkyl sulfate group having an alkyl group of 1 to 3 carbon atoms.

3. A softener composition for fabrics as set forth in claim 1 wherein the ether carboxylate has the formula:

$$R_8O(CH_2CH_2O)_pCH_2COONa$$

wherein $R_8$ is alkyl or alkenyl having 10 to 22 carbon atoms, and p is a number of from zero to 5.

4. A softener composition for fabrics as set forth in claim 1 wherein the quaternary ammonium salt is di-(hydrogenated beef tallow alkyl)dimethyl ammonium chloride and the ether carboxylate has the formula:

$$C_{18}H_{37}O(CH_2CH_2O)_pCH_2COONa$$

wherein p is a number of from zero to 5.

5. A softener composition for fabrics as set forth in claim 1 in which said quaternary ammonium salt is selected from the group consisting of compounds having the formulas

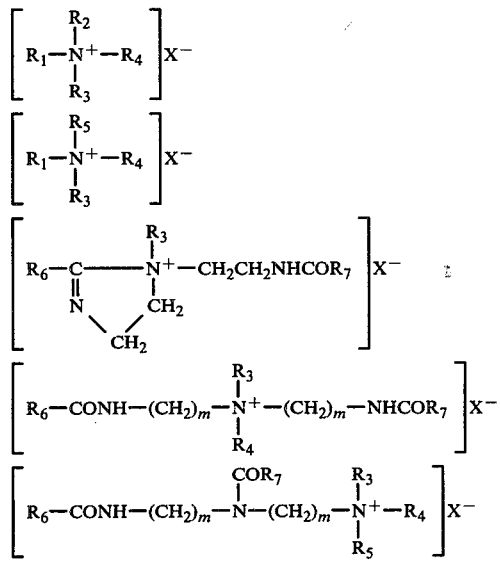

and mixtures thereof, wherein $R_1$, $R_2$, $R_6$ and $R_7$ each is alkyl having 11 to 24 carbon atoms or β-hydroxyalkyl having 13 to 24 carbon atoms, $R_3$, $R_4$ and $R_5$ each is alkyl or hydroxyalkyl having one to 3 carbon atoms, benzyl or $-(C_2H_4O)_nH$ wherein n is from one to 3, m is 2 or 3 and X is chloro, bromo or monoalkyl ($C_1$ to $C_3$) sulfate.

6. A softener composition for fabrics as set forth in claim 1 wherein said quaternary ammonium salt is selected from the group consisting of dodecyltrimethyl ammonium chloride, hexadecyldimethylethyl ammonium bromide, octadecyltrimethyl ammonium chloride, didodecyldimethyl ammonium chloride, dihexadecyldimethyl ammonium chloride, dioctadecyldimethyl ammonium chloride, di-(hydrogenated beef tallow alkyl)dimethylammonium chloride, 2-heptadecyl-1-methyl-1-[(2-octadecanoylamino)ethyl]imidazolinium methyl sulfate, di-[(2-dodecanoylamino)ethyl]dimethyl ammonium methyl sulfate, di-[(2-octadecanoylamino)ethyl]methylethyl ammonium ethyl sulfate, and mixtures of two or more of those quaternary ammonium salts and said ether carboxylate is selected from the group consisting of sodium 2-(dodecyloxy)-acetate, potassium 2-(dodecyloxytriethenoxy)-2-ethyl-acetate, ammonium 3-(hexadecyloxyethenoxy)propionate, sodium 2-(octadecyloxytriethenoxy)-acetate, sodium 2-(octadecenyloxydiethenoxy)-acetate, and mixtures of two or more of these ether carboxylates.

7. A softener composition for fabrics as set forth in claim 1 in which the mixing molar ratio of (A):(B) is from 1:0.75 to 1:0.9.

8. A liquid softener composition for fabrics as claimed in claim 6 wherein the sum of the weights of (A) and (B) is from about 3 to about 20 percent by weight, and the balance is essentially water.

* * * * *